United States Patent [19]

Ivins et al.

[11] Patent Number: 4,488,852

[45] Date of Patent: Dec. 18, 1984

[54] SUBMERSIBLE PUMP APPARATUS

[75] Inventors: Earl E. Ivins; John L. Ivins, both of Lakewood, Calif.

[73] Assignee: Engineers Sales-Service Co., Inc., Los Angeles, Calif.

[21] Appl. No.: 213,922

[22] Filed: Dec. 8, 1980

Related U.S. Application Data

[63] Continuation-in-part of Ser. No. 947,170, Sep. 28, 1978, abandoned, which is a continuation-in-part of Ser. No. 745,332, Nov. 26, 1976, Pat. No. 4,134,711.

[51] Int. Cl.[3] ..... F04B 39/06

[52] U.S. Cl. ..... 417/211.5; 417/370

[58] Field of Search ..... 417/211.5, 369, 370

[56] References Cited

U.S. PATENT DOCUMENTS

| | | | |
|---|---|---|---|
| 1,493,509 | 1/1922 | Willey | 415/116 X |
| 1,891,201 | 12/1932 | Hoff | 415/116 |
| 2,140,744 | 12/1938 | Hirsch | 134/200 X |
| 2,536,843 | 1/1951 | Dye . | |
| 2,701,529 | 2/1955 | Finzel | 417/424 |
| 3,118,384 | 1/1964 | Sence et al. | 417/370 |
| 3,223,043 | 12/1965 | Shapiro | 417/370 |
| 3,307,828 | 3/1967 | Willi | 415/116 |
| 3,407,099 | 10/1968 | Schell | 148/153 |
| 3,572,976 | 3/1971 | Sato | 417/369 |
| 3,583,413 | 1/1971 | Mertzanis | 134/94 |
| 3,762,411 | 10/1973 | Lloyd et al. | 128/230 |
| 3,868,198 | 2/1975 | Purtell | 417/53 |
| 4,028,011 | 6/1977 | Kramer | 417/278 |
| 4,134,711 | 1/1979 | Ivins et al. | 417/370 |

FOREIGN PATENT DOCUMENTS

| | | | |
|---|---|---|---|
| 1403238 | 11/1968 | Fed. Rep. of Germany | 817/369 |

OTHER PUBLICATIONS

Model 4X12 TF, Universal Vortex Fluid Submersible Pump, by Essco, 1977, Los Angeles, CA.

*Primary Examiner*—Richard E. Gluck

*Attorney, Agent, or Firm*—Fulwider, Patton, Rieber, Lee & Utecht

[57] ABSTRACT

A submersible pump apparatus for admitting air into the low pressure vortex area of the pump to control the amount of liquid material discharged, and including an improved vent and spray system for venting air from the impeller and for directing liquid material onto the pump motor exterior for cooling.

2 Claims, 5 Drawing Figures

FIG. 1
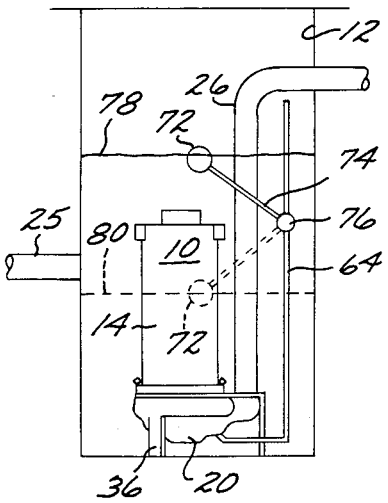
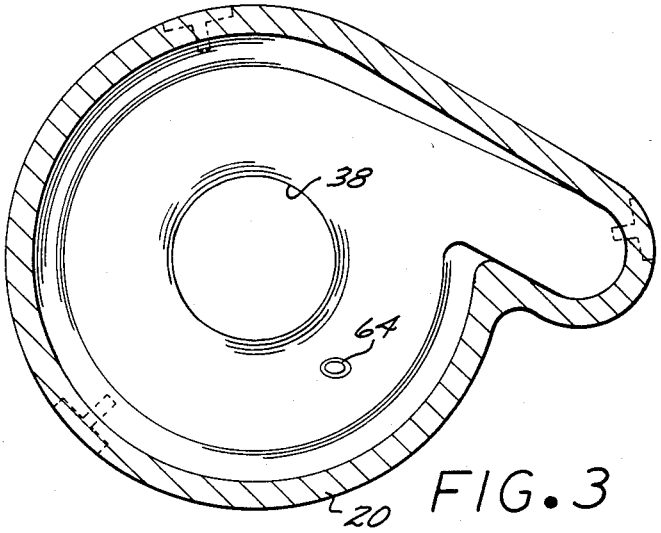
FIG. 3
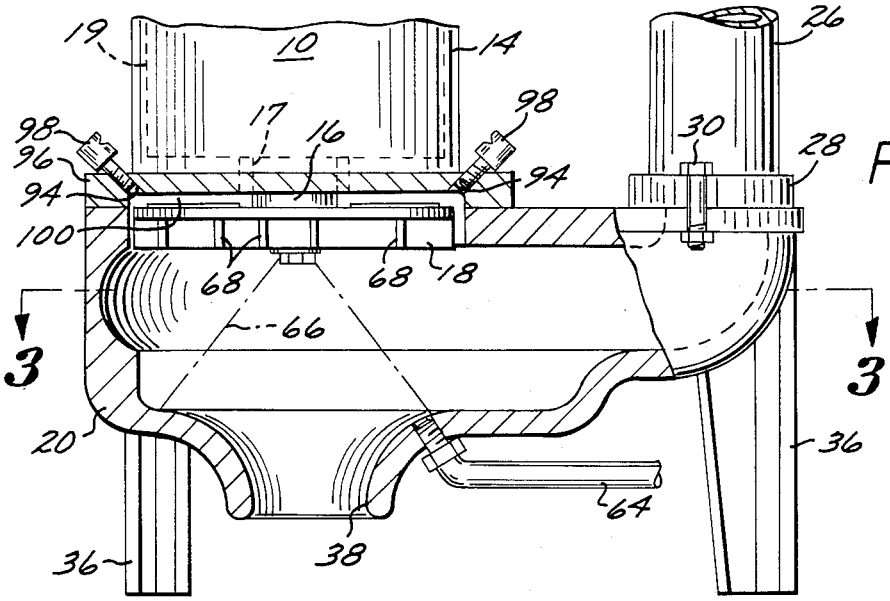
FIG. 2
FIG. 5
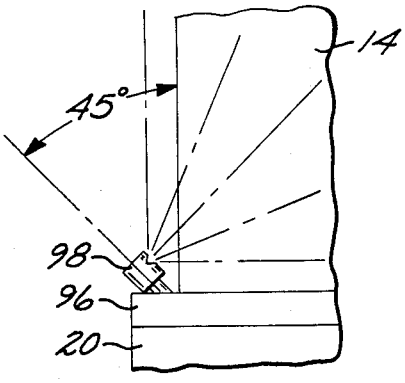
FIG. 4
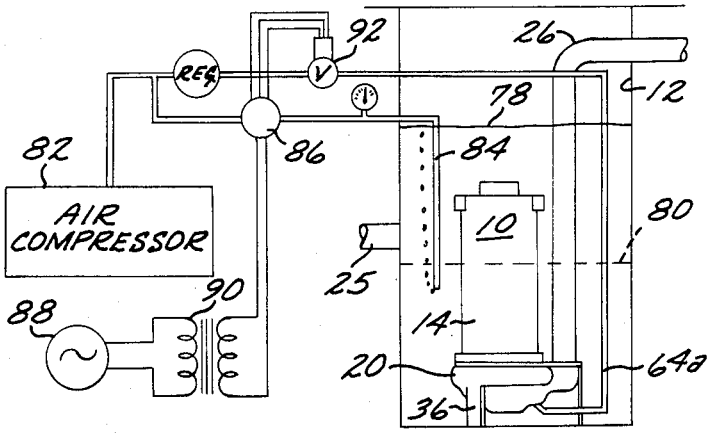

SUBMERSIBLE PUMP APPARATUS

CROSS-REFERENCE TO RELATED APPLICATION

This is a continuation-in-part of applicant's co-pending application, U.S. Ser. No. 947,170, filed Sept. 28, 1978, entitled "SUBMERSIBLE PUMP APPARATUS", now abandoned which is in turn a continuation-in-part of applicant's application, U.S. Ser. No. 745,332, filed Nov. 26, 1976, now U.S. Pat. No. 4,134,711 entitled "SUBMERSIBLE PUMP APPARATUS", and the filing dates of said applications are claimed for subject matter common to those cases and this case.

The additional subject matter of the present application includes material relating to means for discharging liquid material and venting air from the back shroud area adjacent the pump impeller to facilitate self-priming, reduce thrust bearing loads, and for cooling of the pump drive motor.

BACKGROUND OF THE INVENTION

1. Field of the Invention

The present invention relates to submersible pump apparatus whose liquid material output can be varied.

2. Description of the Prior Art

In the submersible pump disclosed in my U.S. Pat. No. 4,134,711, issued Jan. 16, 1979, which is designed for location in a sump or the like, a relatively inexpensive and simple way is shown to vary the amount of liquid material pumped to accomodate differential rates of flow of the liquid material into the sump. However, there is lacking a completely satisfactory way to vent air from the back shroud area of the pump impeller to facilitate self-priming and to reduce thrust bearing loads. Further, the venting hardware which is shown for combining the venting function with the spray system for cooling the pump motor is relatively exposed, and it is therefore susceptible to accidental damage.

Prior art devices other than that disclosed in my patent typically either intermittently operate the pump motor according to the sensed level of the liquid material, or control the rate of liquid material discharged by varying the speed of rotation of the pump impeller. Thus, the impeller rotates at higher speeds when the sump is relatively full, and rotates at lower speeds when the liquid level decreases. The impeller speed has been controlled in a number of ways in the prior art. Some devices employ an oil bath or magnetic clutch to vary the impeller speed, while maintaining the speed of the drive motor constant. Other devices vary the speed of the drive motor itself, as by frequency control or the like. All of such systems tend to be relatively expensive and complex.

The present apparatus is similar to the apparatus of my patent, controlling the quantity of liquid material by aspiration or injection of air, but it includes an improved vent and spray apparatus.

SUMMARY OF THE INVENTION

According to the present invention, submersible pump apparatus is provided which is adapted for location in a sump or the like, and which includes a motor case, a driving motor, an impeller case, and an impeller located in the impeller case, the impeller defining a back shroud space between its upper face and the confronting, superjacent portion of the impeller case. The impeller is rotatable to develop a low pressure vortex below the impeller in the area adjacent the impeller inlet.

The apparatus includes a vent which opens at one end into the back shroud space and at the other end opens to the exterior of the impeller case. Whenever air is drawn or injected into the low pressure vortex area of the pump for controlling the amount of liquid discharged, the air collecting in the back shroud space is constantly vented to facilitate operation of the impeller and reprime the pump.

The present apparatus includes spray heads coupled to the air vent, and angularly inclined to direct liquid material onto the motor case for cooling, the liquid material being drawn from the back shroud space along with the vented air and other gases which may be present.

The present pump apparatus is operative in conjunction with various means for controlling air admission to the low pressure vortex area of the pump impeller, including means providing natural air aspiration through a conduit opening to atmosphere, and means for injecting air supplied by a suitable compresser. Such air supply means normally include suitable valving for initiating air aspiration or injection as soon as the level of liquid material in the sump drops below a predetermined level, the rate of air flow increasing as the liquid level drops so as to maintain the liquid level within a desired range. However, the present vent and spray means is so effective in maintaining impeller pumping at high rates of air injection that it makes possible the use in some sump operations of a pump apparatus not having any liquid material level control. In such an application, the liquid material level falls to a level approximating that of the pump inlet, and air is immediately drawn into the inlet and into the impeller vortex area. Instead of a complete loss of prime and discontinuation of further pumping, as would occur with most prior art pumps, air is vented from the back shroud area constantly so that the pump can commence normal operation as soon as the liquid material level rises. In addition, in such an unsubmerged condition a prior art pump motor would become overheated and burn out. With the present improved vent and spray apparatus, the available water which is drawn into the back shroud area is sprayed onto the motor case for cooling.

Other objects and features of the invention will become apparent from consideration of the following description, taken in connection with the accompanying drawings.

BRIEF DESCRIPTION OF THE DRAWINGS

FIG. 1 is a partially diagrammatic view of a submersible pump according to the present invention, the pump being located in a typical sump for pumping sewage or industrial waste materials, the liquid material level being controlled by natural air aspiration;

FIG. 2 is an enlarged cross-sectional view of the lower portion of the pump, particularly including the impeller and impeller case area;

FIG. 3 is a view taken along the line 3—3 of FIG. 2;

FIG. 4 is a detailed view illustrating the spray pattern of one of the spray heads shown in FIG. 2; and FIG. 5 is a partially diagrammatic view similar to FIG. 1, but illustrating an injected or compressed air system for controlling the level of the liquid material.

DESCRIPTION OF THE PREFERRED EMBODIMENTS

Referring now to the drawings, there is illustrated an elongated pump 10 adapted for vertical orientation in a sump 12 and including a motor case 14 and a drive shaft 16 extending downwardly through a shaft seal 17 from a pump motor 19 located within the case 14 and generally indicated in dotted outline in FIG. 3. The shaft 16 is coupled to an impeller 18 located in an impeller case 20 for rotation of the impeller 18 to pump liquid material out of the sump 12.

The usual submersible pump is sealed against fluid entry for operation in a submerged condition, and is designed to be cooled by the liquid material within which it is submerged. Dangerous overheating can occur if such a pump is not operated in a submerged condition, and such overheating may result in burning or explosion of the motor. Under normal circumstances a sump within which such a prior art pump is to operate must be made deep enough to cover the pump motor case during all usual fluctuations in the level of the liquid material being pumped. Such a deep sump is shown in FIG. 1.

I have heretofore disclosed a system whereby a shallower sump can be employed, the pump being cooled at all liquid levels down to and including the level of the pump inlet. The present system is an improved means for accomplishing the foregoing as well as other objects.

Referring to FIG. 1, the pump 10 is provided with power by means of a cable (not shown) connected to an external power source. Liquid material to be pumped enters an inlet pipe 25 and is pumped out of the sump 12 through a discharge pipe 26 connected at its flanged end 28, as seen in FIG. 2, to the impeller case 20 by a pair of nut and bolt assemblies 30, only one of which is illustrated.

In contrast to most prior art systems, the present submersible pump apparatus does not operate the pump motor in an on-off manner as the level of liquid material in the sump 12 fluctuates. Instead, the pump operates continuously, the volume of liquid material discharged being modulated to adjust or maintain the liquid material at the desired level.

The impeller case 20 includes a plurality of supporting legs 36 which space the impeller inlet 38 a suitable distance above the floor of the sump 12, as best seen in FIGS. 1 and 5. In a vertically oriented submersible pump there is characteristically a generally conical, low pressure vortex area 66, as seen in FIG. 2, having its base adjacent the impeller inlet 38 and its apex just below the impeller 18. Material to be pumped is drawn upwardly by this low pressure region into the impeller 18. The plurality of radially-directed impeller blades 68 thrust the material outwardly, the impeller 18 being provided with an angularly inclined flange which directs the outwardly thrust material downwardly and into the discharge pipe 26.

In the embodiment of FIG. 1 in which air can be naturally aspirated into the low pressure vortex area 66, one end of a conduit 64 is connected at its lower end to the impeller case 20 in fluid communication with the interior of the case 20 adjacent the base of the vortex area 66, as seen in FIG. 2. The upper end of the conduit 64 is open to atmosphere above the level of the liquid material. This enables atmospheric air to be aspirated or drawn into the area 66. Controlling the flow of this air is a relatively simple and inexpensive means for varying the output of the pump as desired, and independently of the rate of rotation of the pump impeller. The effect of the air is to displace some of the liquid material which would otherwise be pumped.

Control of the rate of air flow through the conduit 64 is achieved in the system of FIG. 1 by use of a float mechanism including a buoyant float 72 connected by an arm 74 to any suitable air valve 76 disposed in the conduit 64. Valve 76 may be any commercially available valve operative to regulate air flow through it according to the position of an associated actuating lever, such as the float arm 74, as will be apparent to those skilled in the art.

The float 72, arm 74 and valve 76 are so mounted that the float 72 swings between an upper level 78 and a lower level 80. As the float drops, the valve 76 opens wider to permit more air to be aspirated through the conduit 70, decreasing the quantity of material pumped. Conversely, when the float rises the valve begins to close and the amount of air aspirated decreases, increasing the quantity of material pumped. Full closure of the valve 76 would allow the pump 10 to operate at maximum capacity. In this manner, the float 72 maintains the liquid level in the sump between the levels 78 and 80.

The system of FIG. 5 is generally similar to that of FIG. 1, except that the air is supplied by an air compressor 82. As in the embodiment of FIG. 1, the volume of air supplied is controlled to vary the air and liquid material mixture passing out of the discharge conduit 26 such that the liquid level in the sump is maintained between the levels 78 and 80. Such control may be accomplished in any suitable fashion, the system illustrated being merely exemplary. In the system illustrated some of the compressed air is directed into a bubbler tube 84 which extends downwardly into the sump, the open lower end of the tube being located just below the lowest desired level for the liquid material.

A surface control unit 86, of a type well-known to those skilled in the art, is responsive to the difference in back pressure at the lower end of the tube 84 as the level of the liquid material varies. The surface control unit 86, which is energized by a power source 88 acting through a transformer 90, generates an output signal operative to control a modulating solenoid air valve 90 which is located in the air line which extends from the compressor 82 to the conduit **64*a* that is in communication with the low pressure vortex area of the pump 10**.

Operation of the system of FIG. 5 is analogous to that of the system of FIG. 1, except that air is injected into the low pressure vortex area of the pump 10 under pressure, rather than by natural aspiration.

As previously indicated the present air venting and liquid spray system is operative with pumps not associated with any liquid level control system. Thus, assuming that the liquid material level occasionally falls to the level of the impeller inlet 38, air will be aspirated into the inlet 38 and quickly reduce the volume of liquid material passing out of the discharge pipe 26. Such air dilution of the discharged liquid material continues until the level of liquid material rises above the impeller inlet 38. Air dilution in this and the other applications does not adversely affect pump operation. The desired reduction in the volume of liquid material is always accompanied by a cooling spray of any liquid material available in the back shroud area, and by venting of air from that area so that the pump immediately and completely reprimes when air aspiration or injection is halted.

The particular vent and spray means empolyed comprises a plurality of vent passages 94 which are drilled through an upper plate 96 of the impeller case 20, the passages being inclined at approximately a 45° angle as best seen in FIG. 4, to accept a corresponding plurality of spray heads 98. The angular inclination of the spray heads 98 is operative to direct liquid material upwardly against the motor case 14 for cooling the case at all times that there is any liquid material available in the back shroud area 100.

The back shroud pressure area 100 is generally characterized by a pressure which is significantly higher than the pressure below the impeller 18, causing a relatively high load on the thrust bearings. The described discharge of water from the back shroud pressure area 100 thus has another important advantage, it reduces pressure in the area 100 and thereby reduces loading of the thrust bearings and prolongs the life of the bearings.

Integral location of the spray heads 98 in the casing and adjacent the base of the motor case 14 eliminates any need for protruding spray rings and connecting tubing, either at the top or bottom of the motor case.

From the foregoing it is seen that use of the spray heads 98 accomplishes a number of important objects. It provides an inexpensive and simple form of vent and spray hardware. It provides a means for quickly venting air from the back shroud pressure area 100; and it enables reduction of pressure in the area 100 by withdrawal of liquid material for spraying upon and cooling the motor case 14.

Various modifications and changes may be made with regard to the foregoing detailed description without departing from the spirit of the invention.

I claim:

1. In a submersible pump adapted for location in a sump or the like and including a motor case and a driving motor in said motor case; an impeller case having an upper, interiorly disposed face, an inlet for receiving liquid material from the sump, and an outlet for discharging liquid material out of the sump; and an impeller located in said impeller case and defining a back shroud space with said face, said impeller being rotatable for developing a low pressure vortex below said impeller adjacent said inlet, the improvement comprising:

vent means defining vent passage means providing communication between said back shroud space and the exterior of said impeller case;

spray means coupled to said vent passage means and opening to the exterior of said impeller case for spraying liquid material from said back shroud space onto the exterior of said motor case for cooling said motor, and for venting air from said back shroud space and to the exterior of said impeller case to facilitate repriming of said pump under conditions of air intake through said inlet; and liquid material discharge control means for controlling the quantity of liquid material discharged through said outlet, independently of the rate of rotation of said impeller, said control means comprising a compressor, conduit means terminating at one end adjacent said low pressure vortex area and coupled at the other end to said compressor for injection of compressed air into said low pressure vortex for discharge through said outlet with said liquid material.

2. The submersible pump improvement according to claim 1 wherein said liquid material discharge control means includes air flow control means coupled to said conduit means, and further includes pressure sensing means responsive to the level of liquid material in said sump to operate said air flow control means for regulating the rate of air flow through said conduit means.

* * * * *